US006539562B1

(12) United States Patent
Bianca

(10) Patent No.: US 6,539,562 B1
(45) Date of Patent: Apr. 1, 2003

(54) LIFTING AND WALKING AID FOR SICK PEOPLE

(75) Inventor: Dellapiana Bianca, Guarene (IT)

(73) Assignee: Bianca Dellapiana Italy, Piero Mollo (IT)

( * ) Notice: Subject to any disclaimer, the term of this patent is extended or adjusted under 35 U.S.C. 154(b) by 0 days.

(21) Appl. No.: 09/673,421

(22) PCT Filed: Apr. 12, 1999

(86) PCT No.: PCT/EP99/02747

§ 371 (c)(1),
(2), (4) Date: Oct. 18, 2000

(87) PCT Pub. No.: WO99/53884

PCT Pub. Date: Oct. 28, 1999

(30) Foreign Application Priority Data

Apr. 20, 1998 (IT) ..... TO980072 U

(51) Int. Cl.[7] ..... A61G 7/14
(52) U.S. Cl. ..... 5/86.1; 135/67; 482/69
(58) Field of Search ..... 5/86.1, 81.1 R, 5/83.1; 135/67, 71, 72, 75; 482/66, 69

(56) References Cited

U.S. PATENT DOCUMENTS 2,459,066 A * 1/1949 Duke
3,778,052 A * 12/1973 Andon et al.
4,461,471 A * 7/1984 Brastow
4,995,412 A 2/1991 Hirn et al. ..... 135/67
5,148,559 A * 9/1992 Morris ..... 5/86.1
5,333,333 A 8/1994 Mah ..... 5/81.1
5,365,621 A * 11/1994 Blain ..... 5/86.1
5,603,677 A 2/1997 Sollo ..... 482/69

FOREIGN PATENT DOCUMENTS

DE 4202 094 A1 * 9/1992 ..... 5/86.1
FR 1090552 3/1955

* cited by examiner

*Primary Examiner*—Alexander Grosz
(74) *Attorney, Agent, or Firm*—Howson and Howson

(57) ABSTRACT

A lifting and walking aid having a framework (1) constructed of a lower horizontal frame (2*a*–2*c*) provided with small casters (9), an upper horizontal frame (2*d*–2*f*) provided with lifting means, and a vertical frame (2*g*–2*n*) secured to both the upper and lower horizontal frames (2*a*–2*c*) and (2*d*–2*f*). The framework comprises a plurality of substantially rectilinear tubular members (2*a*–2*y*) which are connected to each other so as to allow for a quick disassembling of the framework (1).

18 Claims, 3 Drawing Sheets

2n
2e
3
2ℓ
4
2i
2f
3
2d
4
10
2h
2m
12a
3
2z
7
7
8
2v
2g
3
2q
2y
8
2p
2u
2s
2x
9
2b
5b
2r
12
2p
2a
9
12b
5a
2c
6b
6a
9

LIFTING AND WALKING AID FOR SICK PEOPLE

FIELD OF THE INVENTION

The present invention relates to a lifting and walking aid, i.e. device for permitting a patient to raise him/herself (e.g. from a bed) and walk about.

BACKGROUND OF THE INVENTION

Such a device is advantageous for lifting sick or invalid people from a supine position in a bed, as well as for holding up a weakened person when walking or a person undertaking a rehabilitation process.

As well known, sick people in the above mentioned conditions need the help of one or more assistants to be able to get on one's feet and walk about.

Such lifting and walking operations are often accomplished under conditions of precarious balance with the risk of a fall or an overstrain potentially harmful both for the sick person and for the person assisting him.

There are known walking aids for sick people and the like as well as devices adapted to lift a sick person from a bed and put him/her into an erect or sitting position.

With reference to the devices of the first type, also known as walkers, such conventional devices do not solve the problem of lifting the sick person and holding the same during the walking and therefore such known devices require the continuous presence of at least one assistant.

On the other hand, the lifting devices are generally bulky and heavy and do not solve the problem of helping the sick person to walk after he/she has been lifted from the bed.

In the past, there have been proposed devices essentially constituted by a walker provided with a harness and lifting means adapted to maintain the walking user in an erect position. One of such devices is described in U.S. Pat. No. 5,603,677.

The device disclosed in the above mentioned US patent comprises a base member supported on small wheels, to which a vertical frame is fixed, the frame being provided with harness means for sustaining the user and with side bars on which the user rests his/her hands when walking.

Such a device is nevertheless bulky and as a further drawback does not allow a person to be directly lifted from the bed.

OBJECTS OF THE INVENTION

A first object of the present invention is therefore to provide a device adapted for assisting a sick person in walking and further adapted to directly raise a sick person from a bed, even from a supine position.

A second object of the present invention is to provide a lifting and walking aid for sick people that is compact and that can be easily disassembled and transported.

Another object of the present invention is to provide a lifting and walking aid for sick people that can be used on uneven ground without prejudice of its compactness and its disassembling and transport capabilities.

SUMMARY OF THE INVENTION

The above and other objects of the present invention are accomplished through a lifting and walking aid for sick people, the aid having a framework comprising a lower horizontal frame (2*a*–2*c*) provided with casters, an upper horizontal frame (2*d*–2*f*) provided with lifting means, and a vertical frame (2*g*–2*n*) secured to both horizontal frames. The framework is constructed with a plurality of substantially rectilinear tubular members (2*a*–2*y*) and the tubular members are connacted to each other so as to allow for quick disassembling without the need of any additional tool.

DESCRIPTION OF THE DRAWINGS

Further characteristics and advantages of the invention will become evident from the following description of an exemplary embodiment of a lifting and walking aid for sick people illustrated hereinafter with referenced to the attached drawings in which.

DETAILED DESCRIPTION OF THE PREFERRED EMBODIMENT

Figure 1:
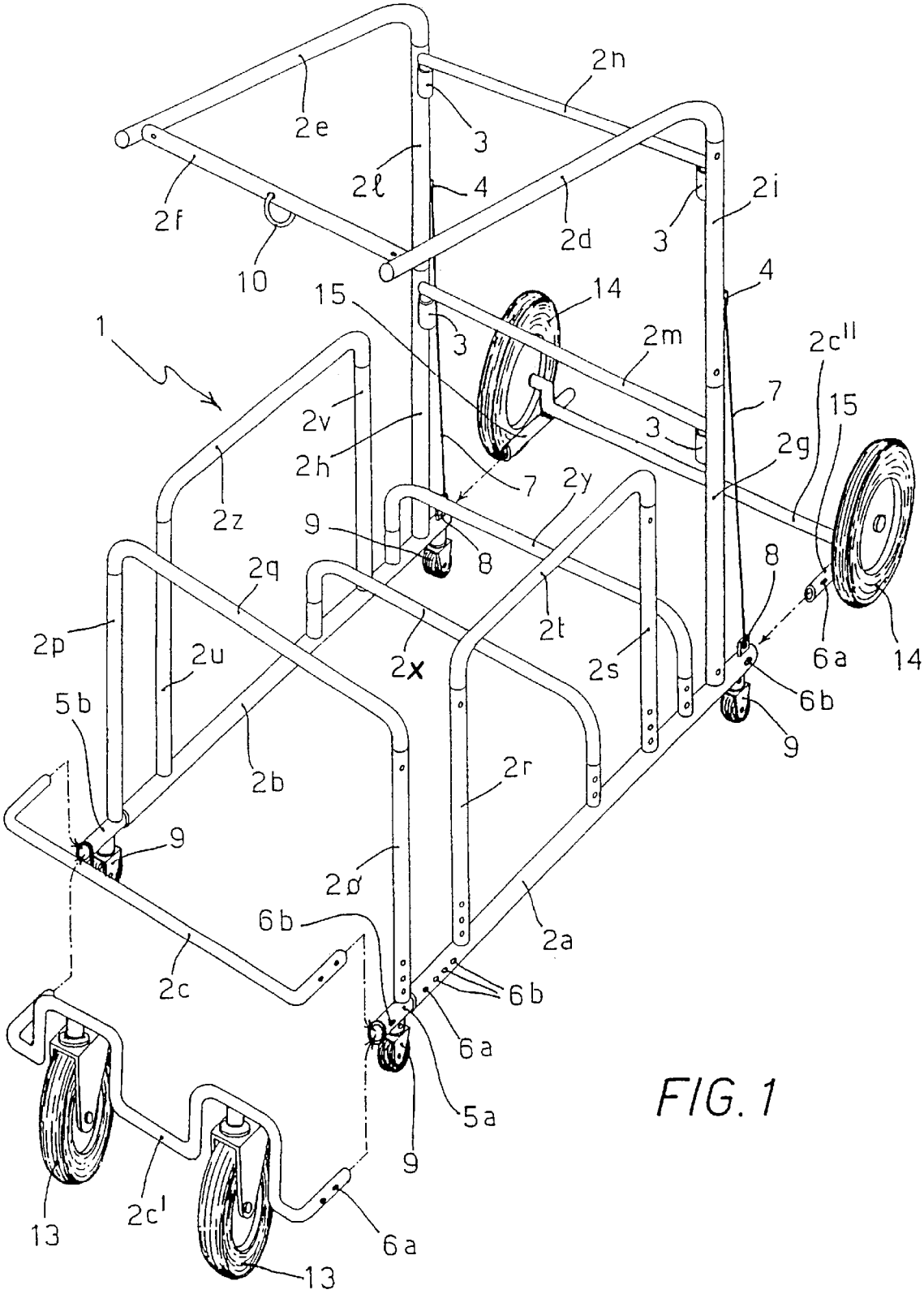
FIG. 1 is a prospective view of an embodiment of a lifting and walking aid according to the invention.
Figure 2:
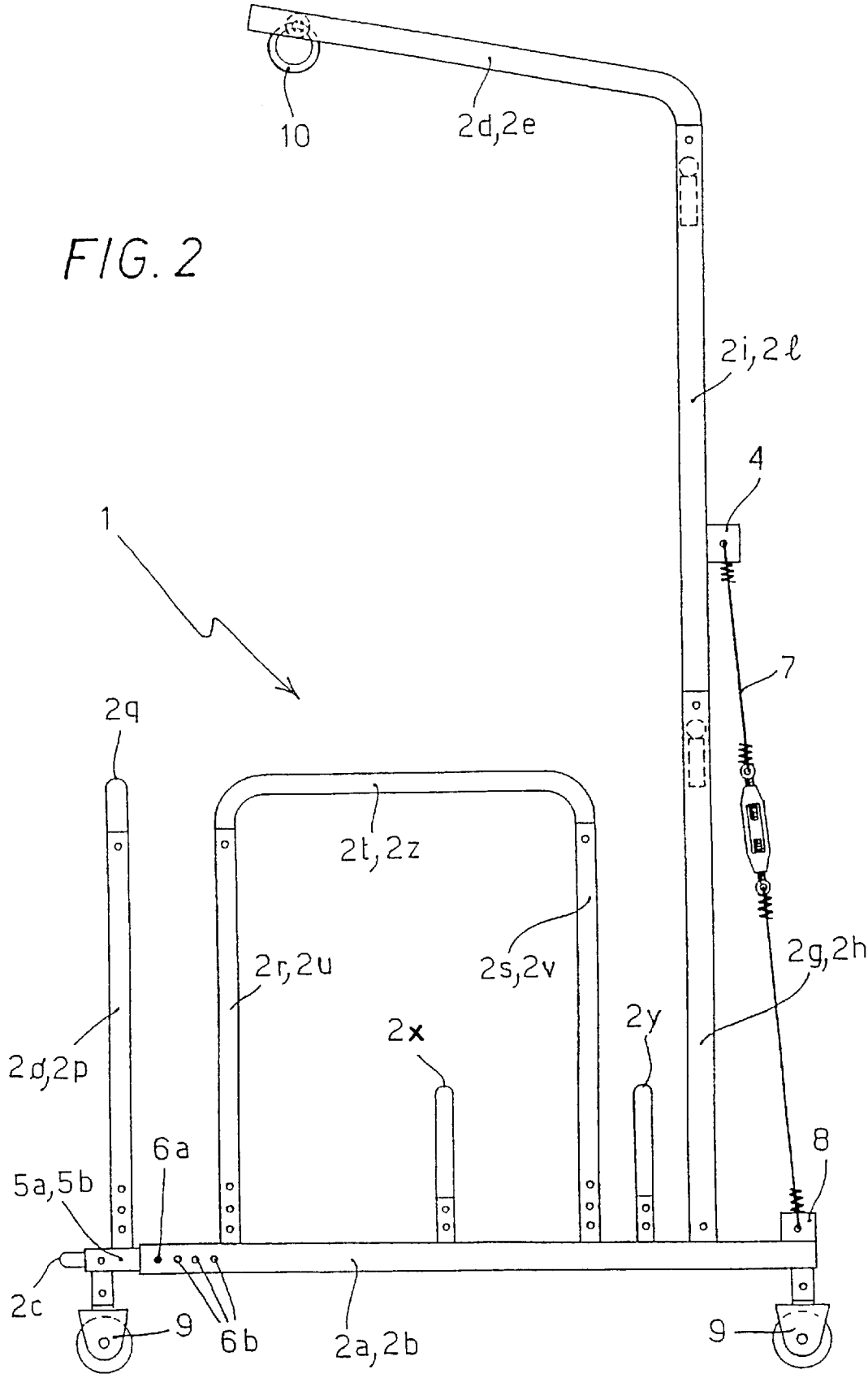
FIG. 2 is a side view of the device of FIG. 1.
Figure 3:
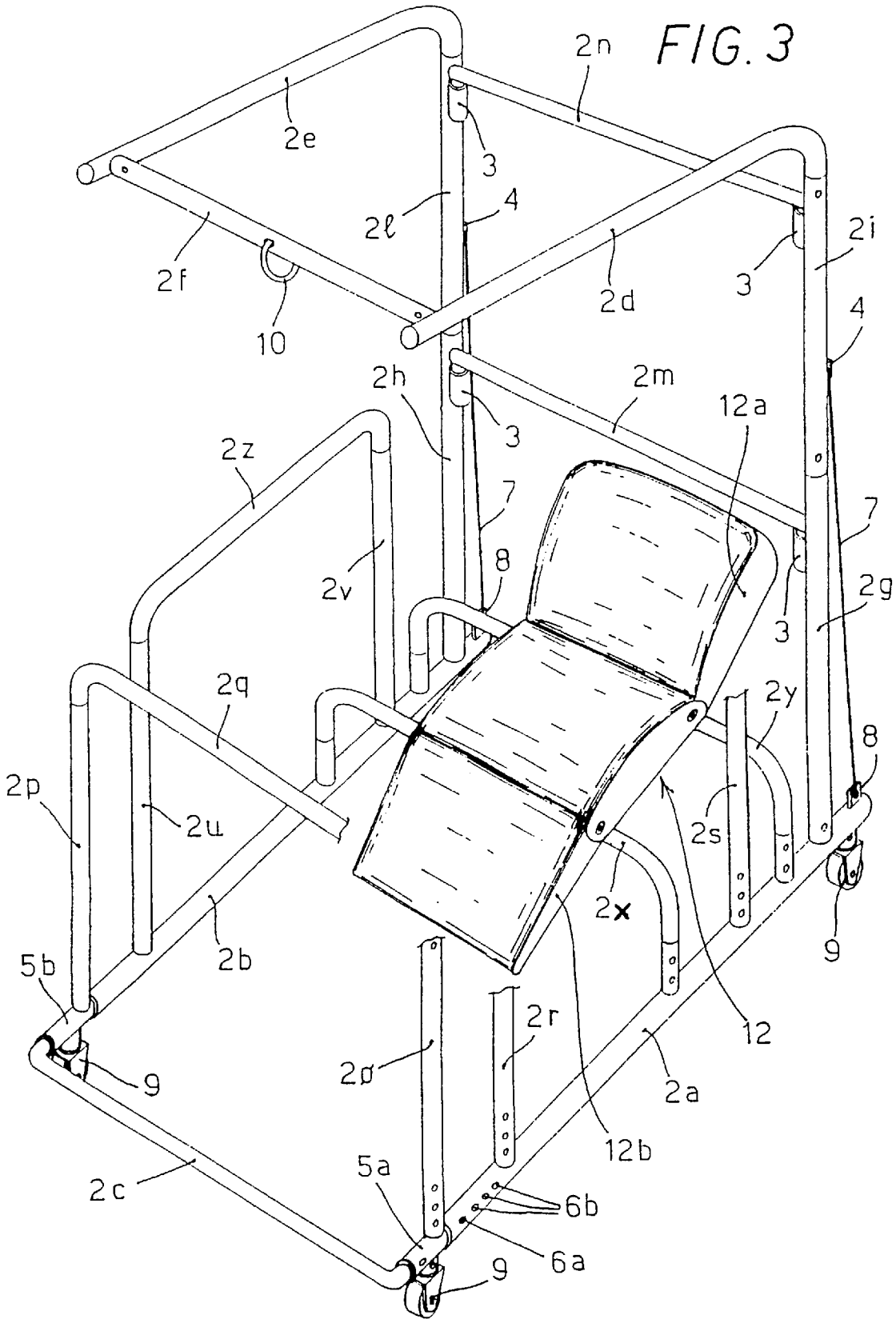
FIG. 3 is a prospective view of the device of FIG. 1 equipped with a seat.

With reference to FIGS. 1 to 3, a device according to the invention comprises a framework 1 realized by releasably assembling together a plurality of tubular members 2*a*–2*y*, such members being connected and secured to one another by fastening means consisting of spring-biased pegs 6*a*, located at the male ends of the tubular members, and holes 6*b* provided at the female ends of the tubular members and adapted to receive the above mentioned spring-biased pegs.

More precisely, the framework 1 includes a lower horizontal frame 2*a*–2*c*, an upper horizontal frame 2*d*–2*f* and a vertical frame 2*g*–2*n* secured to both the horizontal frames 2*a*–2*c* and 2*d*–2*f*.

The lower frame 2*a*–2*c* comprises a pair of parallel tubular side members 2*a*, 2*b* joined by a tubular transverse member 2*c* with the ends folded at 90° and defining the front portion of the lower frame 2*a*–2*c*.

The transverse member 2*c* is connected to the members 2*a*, 2*b* through two short pipe sections 5*a*, 5*b*, each being telescopically inserted into the front end of each tubular side member 2*a*, 2*b* and coupled to the folded ends of member 2*c*.

Advantageously, the pipe sections 5*a*, 5*b* together with a plurality of holes 6*b* provided at the female or receiving ends of members 2*a* and 2*b*, allow for adjusting the position of the front portion of the lower frame 2*a*–2*c*, through the engagement of the spring-biased pegs 6*a* in pipe sections 5*a*, 5*b* with such holes.

The lower frame 2*a*–2*c* is further provided with four small swivel wheels or casters 9, with a pair of wheels being fastened to the sections 5*a*, 5*b* and the other pair being fastened to those ends of members 2*a*, 2*b* that are far from the pipe sections 5*a*, 5*b*.

By providing a pair of swivel wheels 9 on the telescopic members 5*a*, 5*b*, the length of the surface of the device can be advantageously changed to properly meet the conditions of use.

Tubular members 2*a*, 2*b* and pipe sections 5*a*, 5*b* further include short sleeve portions for receiving the ends of U-shaped subframes, respectively subframes 2*r*–2*t* and 2*u*–2*z* forming two side handrails, and of a transversely extending subframe 2*o*–2*q* forming a front handrail, on which the sick person can lean.

Two additional U-shaped frames 2*x* and 2*y* are transversely fixed with their ends to both tubular members 2*a*, 2*b* and form a support for a seat 12 (FIG. 3) on which the sick person can sit when the device is not used for walking.

The seat 12 is preferably a removable seat and comprises a backrest 12*a* and a leg-rest 12*b* that are hinged to the seat body, and their positions are adjustable for providing better comfort to the patient.

Both side handrails 2*r*–2*t*, 2*u*–2*z* and the front handrail 2*o*–2*q* can be disassembled since each comprises three tubular sections that are joined to one another by fastening means formed by spring-biased pegs 6*a*, provided at the male end of said tubular sections, and engaging corresponding holes 6*b*, provided on the female end of the tubular sections.

Handrails 2*r*–2*t*, 2*u*–2*z* and 2*o*–2*q* are secured to joints or coupling members provided on the lower frame 2*a*–2*c* through spring-biased pegs 6*a* engaging a plurality of holes 6*b* for adjusting the height of the side handrails 2*r*–2*t*, 2*u*–2*z* and of the front handrail 2*o*–2*q*.

On the rear portion of the frame 2*a*–2*c* the members 2*a*, 2*b* are provided with a pair of joints or coupling members provided with spring-biased pegs 6*a* adapted to engage holes 6*b* on the vertical frame 2*g*–2*n* for securing the vertical frame 2*g*–2*n* to the frame 2*a*–2*c*.

The vertical frame 2*g*–2*n* comprises a pair of lower tubular members 2*g*, 2*h*, a pair of upper tubular members 2*i*, 2*l* joined to the members 2*g*, 2*h*, and two crossbars 2*m*, 2*n* the ends of which are inserted into two pairs of sockets 3 welded to the members 2*g*, 2*h* and 2*i*, 2*l*.

A pair of tension wires or rods 7 for reinforcing the connection between the vertical frame 2*g*–2*n* and the base frame 2*a*–2*c* are secured with one end to a pair of eyelets 4 on the tubular members 2*i*, 2*l* and with the other ends to a pair of eyelets 8 fixed to the rear end of the tubular members 2*a*, 2*b*.

The upper horizontal frame 2*d*–2*f* includes a pair of side tubular members 2*d*, 2*e* each having a folded end to be fitted into the open end of the tubular members 2*i*, 2*l* of the vertical frame 2*g*–2*n*.

Near their front ends the tubular members 2*d*, 2*e* are provided with a pair of joints or coupling members for fitting a transverse tubular member 2*f*.

For assembling the device according to the invention, the tubular members 2*a*–2*y* forming the framework 1 are joined together and then the adjustable tubular members are positioned at the desired positions.

For an easier fitting of the vertical upper frame portions formed by the members 2*i*, 2*l*, 2*n* onto the portion of the lower vertical frame formed by the members 2*g*, 2*h*, 2*m*, the tubular members 2*g* and 2*h* and the members 2*i* and 2*l* have different lengths.

At the center of the tubular member 2*f* there is further provided a ring 10 to which a hoist or other lifting means is secured for lifting and sustaining the sick person through a suitable strap or harness. Such lifting means can be either electrically or manually or otherwise operated and is not illustrated since it is known in the art.

Each of the folded ends of the side tubular members 2*d*, 2*e* in the upper frame 2*d*–2*f*, is folded at an angle such that the front portion of the upper horizontal frame 2*d*–2*f* is slightly raised relative to the folded ends (see FIG. 2) to ensure room enough for the operation of the lifting means in spite of the lowering of the upper horizontal frame 2*d*–2*f* caused by the weight of the sick person.

Thanks to the possibility of a quick removal of the handrails 2*r*–2*t*, 2*u*–2*z* and 2*o*–2*q* as well as of the two U-shaped frames 2*x* and 2*y*, the base frame 2*a*–2*c* can be easily slid under the bed on which the patient lies.

Consequently, the front portion of the upper frame 2*d*–2*f* to which the ring 10 for lifting the patient is fixed can be precisely positioned above the sick person to be lifted.

Moreover since the framework 1 can be completely disassembled in a number of substantially rectilinear tubular members, the device of the invention can be further advantageously carried in a small size container such as a bag.

With referenced now to FIG. 1, the transverse tubular member 2*c* can be replaced by a member 2*c*' equipped with a pair of properly shaped and sized swivel wheels or casters 13 for using the device over irregular surfaces.

Moreover, a transverse member 2*c*" provided with a pair of wheels 14 properly sized for the movement over irregular surfaces can be fitted into the back ends or the tubular members 2*a* and 2*b*.

The tubular member 2*c*" and the back ends of the tubular members 2*a* and 2*b* are joined together by means of spring-biased pegs 6*a* provided on a pair of joints or coupling members 15 welded to the tubular member 2*c*" and engaging corresponding holes 6*b* on the back ends of tubular members 2*a* and 2*b*.

By providing transverse members 2*c*' and 2*c*" equipped with properly sized wheels 13, 14 the lower frame can be positioned at a height from the ground allowing the use of the device over surfaces that are not perfectly smooth.

What is claimed is:

1. A lifting and walking aid for sick people having a framework equipped with wheels or casters and means (10) for lifting and/or supporting a sick person, said framework comprising:

a lower horizontal frame (2*a*–2*c*) having of a pair of parallel side tubular members (2*a*, 2*b*) and a transverse tubular member (2*c*, 2*c*') the ends of which are folded at 90° and connected to said side tubular members (2*a*, 2*b*) so as to define a front portion of said lower frame (2*a*–2*c*), said lower frame (2*a*–2*c*) being provided with first four swivel wheels or casters;

a vertical frame (2*g*–2*n*) joined to the rear portion of said lower horizontal frame (2*a*–2*c*) by means of coupling members provided therein and including a pair of lower tubular members (2*g*, 2*h*), a pair of upper tubular members (2*i*, 2*l*) fitted to said lower members (2*g*, 2*h*) and two crossbars (2*m*, 2*n*) having folded ends to be fitted within two pairs of sockets (3) fixed to said lower and upper tubular members respectively;

an upper horizontal frame (2*d*–2*f*) having a pair of parallel side tubular members (2*d*, 2*e*), the rear ends of which are folded for joining said upper frame to said upper tubular members (2*i*, 2*l*) of said vertical frame (2*g*–2*n*), and a transverse tubular member (2*f*) joined to said side tubular members by means of coupling members provided near the front ends of said side tubular members (2*d*, 2*e*), said transverse tubular member (2*f*) being provided with means for lifting and/or supporting the sick person;

wherein the coupling of said tubular members and crossbars is obtained by means of joints comprising male and female portions equipped with spring-biased pegs provided on said male portions and adapted to engage corresponding holes (6*b*) provided on said female portions, whereby said framework (1) can be easily completely disassembled without the need of any additional tool.

2. A lifting and walking aid according to claim 1, wherein said transverse tubular member of the lower frame is connected to said side members of said lower frame through adjustable intermediate telescopic sections (5*a*, 5*b*) each of which is provided with a small swivel wheel or caster (9), whereby the length of said lower frame can be advantageously changed to properly meet the conditions of use.

3. A lifting and walking aid according to claim 2, wherein three U-shaped frames (2*r*–2*t*, 2*u*–2*z*, 2*o*–2*q*) are secured to said lower horizontal frame (2*a*–2*c*) to define a pair of side handrails and a front handrail to which a sick person can lean when walking.

4. A lifting and walking aid according to claim 3, wherein said lower horizontal frame (2*a*–2*c*) comprises two U-shaped frames (2*x*, 2*y*) on which a detachable seat (12) is secured.

5. A lifting and walking aid according to claim 4, wherein said U-shaped frames are removably fitted to corresponding tubular joints provided on said lower frame (2*a*–2*c*).

6. A lifting and walking aid according to claim 4, wherein said seat (12) comprises a back rest (12*a*) and a leg-rest (12*b*), both being adjustable for comfortably receiving a sick person.

7. A lifting and walking aid according to claim 3, wherein said U-shaped frames are removably fitted to corresponding tubular joints provided on said lower frame (2*a*–2*c*).

8. A lifting and walking aid according to claim 7, wherein the height of said U-shaped frames from said lower horizontal frame (2*a*–2*c*) is adjustable by means of a plurality of holes (6*b*) on the end of said U-shaped frames fitted to said joints, said holes being adapted to engage corresponding spring-biased pegs (6*a*) on said joints.

9. A lifting and walking aid according to claim 3, wherein said transverse member (2*c*, 2*c*') is provided with a pair of second swivel wheels or casters (13), and wherein a transverse member (2*c*") of the lower frame provided with a pair of third wheels (14) is fitted to the ends of said side parallel tubular members (2*a*, 2*b*), said second and third wheels being larger than said first four swivel wheels or casters (9) fitted to said lower horizontal frame.

10. A lifting and walking aid according to claim 1, wherein three U-shaped frames (2*r*–2*t*, 2*u*–2*z*, 2*o*–2*q*) are secured to said lower horizontal frame (2*a*–2*c*) to define a pair of side handrails and a front handrail to which a sick person can lean when walking.

11. A lifting and walking aid according to claim 10, wherein said lower horizontal frame (2*a*–2*c*) comprises two U-shaped frames (2*x*, 2*y*) on which a detachable seat (12) is secured.

12. A lifting and walking aid according to claim 11, wherein said U-shaped frames are removably fitted to corresponding tubular joints provided on said lower frame (2*a*–2*c*).

13. A lifting and walking aid according to claim 11, wherein said seat (12) comprises a back rest (12*a*) and a leg-rest (12*b*), both being adjustable for comfortably receiving a sick person.

14. A lifting and walking aid according to claim 10, wherein said U-shaped frames are removably fitted to corresponding tubular joints provided on said lower frame (2*a*–2*c*).

15. A lifting and walking aid according to claim 14, wherein the height of said U-shaped frames from said lower horizontal frame (2*a*–2*c*) is adjustable by means of a plurality of holes (6*b*) on the end of said U-shaped frames fitted to said joints, said holes being adapted to engage corresponding spring-biased pegs (6*a*) on said joints.

16. A lifting and walking aid according to claim 10, wherein said transverse member (2*c*, 2*c*') is provided with a pair of second swivel wheels or casters (13), and wherein a transverse member (2*c*") of the lower frame provided with a pair of third wheels (14) is fitted to the ends of said side parallel tubular members (2*a*, 2*b*), said second and third wheels being larger than said first four swivel wheels or casters (9) fitted to said lower horizontal frame.

17. A lifting and walking aid according to claim 16, wherein the folded ends of said parallel side tubular members (2*d*, 2*e*) in said upper horizontal frame are folded at an angle such that the front portion of said upper horizontal frame (2*d*–2*f*) is slightly raised relative to said folded ends of said parallel side tubular members (2*d*, 2*e*).

18. A lifting and walking aid according to claim 1, wherein a pair of tension wires or rods (7) is provided between said vertical frame (2*g*–2*n*) and said lower horizontal frame (2*a*–2*c*), said tension wires or rods (7) being fixed to the upper tubular members (2*i*, 2*l*) of said vertical frame (2*g*–2*n*) and to the back end of the tubular members (2*a*, 2*b*) of said lower horizontal frame (2*a*–2*c*) to reinforce the joining between said vertical frame (2*g*–2*n*) and said lower horizontal frame (2*a*–2*c*).

* * * * *

UNITED STATES PATENT AND TRADEMARK OFFICE

CERTIFICATE OF CORRECTION

PATENT NO. : 6,539,562 B1
DATED : April 1, 2003
INVENTOR(S) : Dellapiana

It is certified that error appears in the above-identified patent and that said Letters Patent is hereby corrected as shown below:

Title page,
Item [12], name should read as follows: -- Dellapiana -- instead of "Bianca".
Item [75], Inventor, "Dellapiana Bianca Guarene (IT)" should read -- Bianca Dellapiana Guarene (IT) --.
Item [73], Assignee, "Bianca Dellapiana Italy; Piero Motto (IT)" should read -- Bianca Dellapiana, Guarene (IT); Piero Motto, Bra (IT) --.

Signed and Sealed this

Sixth Day of April, 2004

JON W. DUDAS
*Acting Director of the United States Patent and Trademark Office*